US006675896B2

(12) United States Patent
George

(10) Patent No.: US 6,675,896 B2
(45) Date of Patent: Jan. 13, 2004

(54) DETONATION TRANSFER SUBASSEMBLY AND METHOD FOR USE OF SAME

(75) Inventor: Flint R. George, Flower Mound, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/802,182

(22) Filed: Mar. 8, 2001

(65) Prior Publication Data

US 2002/0125045 A1 Sep. 12, 2002

(51) Int. Cl.[7] ..... E21B 29/12

(52) U.S. Cl. ..... 166/297; 166/55; 175/4.55; 175/4.56; 175/4.6; 102/322

(58) Field of Search ..... 166/297, 338, 166/55, 55.1, 55.2; 175/4.55, 4.56, 4.6; 89/1.15; 102/318, 320, 322, 217

(56) References Cited

U.S. PATENT DOCUMENTS

| | | | | | |
|---|---|---|---|---|---|
| 2,261,859 | A | * | 11/1941 | Ricou | 175/4.56 |
| 4,566,544 | A | * | 1/1986 | Bagley et al. | 166/297 |
| 4,850,438 | A | * | 7/1989 | Regalbuto | 102/310 |
| 4,911,251 | A | * | 3/1990 | George et al. | 102/275.11 |
| 4,969,525 | A | * | 11/1990 | George et al. | 102/319 |
| 5,031,755 | A | * | 7/1991 | Blakeley | 285/112 |
| 5,223,665 | A | * | 6/1993 | Burleson et al. | 102/312 |
| 5,259,315 | A | | 11/1993 | Rekas | 102/275.5 |
| 5,355,957 | A | * | 10/1994 | Burleson et al. | 166/297 |
| 5,490,563 | A | * | 2/1996 | Wesson et al. | 166/297 |
| 5,529,127 | A | * | 6/1996 | Burleson et al. | 166/380 |
| 5,551,520 | A | * | 9/1996 | Bethel et al. | 175/4.54 |
| 5,571,986 | A | * | 11/1996 | Snider et al. | 102/275.11 |
| 5,603,384 | A | * | 2/1997 | Bethel et al. | 175/4.54 |
| 5,680,905 | A | * | 10/1997 | Green et al. | 166/297 |
| 5,890,539 | A | * | 4/1999 | Huber et al. | 166/297 |
| 5,911,277 | A | * | 6/1999 | Hromas et al. | 166/297 |
| 5,971,072 | A | * | 10/1999 | Huber et al. | 166/297 |
| 6,155,344 | A | | 12/2000 | Myers, Jr. et al. | 166/55.1 |
| 6,182,750 | B1 | * | 2/2001 | Edwards et al. | 166/55.1 |
| 6,220,370 | B1 | * | 4/2001 | Wesson et al. | 102/320 |

FOREIGN PATENT DOCUMENTS

| | | | |
|---|---|---|---|
| EP | 0 416 915 A2 | 3/1991 | E21B/43/1185 |

OTHER PUBLICATIONS

Snapshot Tubing–Conveyed Perforating Gun Deployment System; Offshore Northern Sea International Con Exhibition Stavanger Norway; p. 2.

* cited by examiner

*Primary Examiner*—Robert E. Pezzuto
*Assistant Examiner*—Thomas Beach
(74) *Attorney, Agent, or Firm*—Lawrence R. Youst

(57) ABSTRACT

A detonation transfer subassembly for coupling two detonation activated tools in a work sting such that the work string may be severed between the two detonation activated tools without risk of a detonation. The detonation transfer subassembly comprises first and second explosive carrying members having a detonation transfer member disposed therebetween. The detonation transfer member defines a longitudinal passageway therein. A firing pin is disposed within the longitudinal passageway. The firing pin has a first position proximate the first explosive carrying member and a second position proximate the second explosive carrying member. The firing pin is propellable from the first position to the second position following a detonation within the first explosive carrying member such that the firing pin impacts an explosive disposed within the second explosive carrying member, thereby transferring detonation from the first explosive carrying member to the second explosive carrying member.

46 Claims, 7 Drawing Sheets

DETONATION TRANSFER SUBASSEMBLY AND METHOD FOR USE OF SAME

TECHNICAL FIELD OF THE INVENTION

This invention relates, in general, to perforating a subterranean wellbore using shaped charges and, in particular to, a detonation transfer subassembly that is installed within a work string between loaded perforating guns to provide an area through which the work string may be severed without the potential for detonating the shaped charges carried in the perforating guns.

BACKGROUND OF THE INVENTION

Without limiting the scope of the present invention, its background will be described with reference to perforating a subterranean formation using shaped charge perforating guns, as an example.

After drilling the section of a subterranean wellbore that traverses a formation, individual lengths of relatively large diameter metal tubulars are typically secured together to form a casing string that is positioned within the wellbore. This casing string increases the integrity of the wellbore and provides a path for producing fluids from the producing intervals to the surface. Conventionally, the casing string is cemented within the wellbore. To produce fluids into the casing string, hydraulic opening or perforation must be made through the casing string, the cement and a short distance into the formation.

Typically, these perforations are created by detonating a series of shaped charges located within the casing string that are positioned adjacent to the formation. Specifically, numerous charge carriers are loaded with shaped charges that are connected with a detonating device, such as detonating cord. The charge carriers are then connected within a tool string that is lowered into the cased wellbore at the end of a tubing string, wireline, slick line, coil tubing or the like. Once the charge carriers are properly positioned in the wellbore such that shaped charges are adjacent to the formation to be perforated, the shaped charges are detonated. Upon detonation, each shaped charge creates a jet that blasts through a scallop or recess in the carrier, creates a hydraulic opening through the casing and cement and then penetrates the formation forming a perforation therein.

It has been found, however, that it may sometimes be necessary to shut in a well due to an out of control well situation while the tool string, including the perforating guns, is disposed within the well. For example, during a snubbing operation or after the well has been perforated. If live shaped charges remain in the perforating guns, it is possible that closing a set of shear rams on a live shaped charge or other explosive components could result in a detonation. If such a detonation occurs, the live shaped charge may fire causing damage and injury to well equipment and personnel.

A need has therefore arisen for an apparatus that can be installed within the tool string between the loaded perforating guns to provide an area through which the tool string may be severed without the potential for detonating the shaped charges carried in the perforating guns. A need has also arisen for such an apparatus that can transfer detonation from one perforating gun to the next perforating gun such that the perforating guns may be fired in sequence.

SUMMARY OF THE INVENTION

The present invention disclosed herein comprises a detonation transfer subassembly that can be installed within a tool string between two detonation activated tools, such as live perforating guns, that provide an area through which the tool string may be severed without the potential for detonating the detonation activated tools. The detonation transfer subassembly of the present invention also provides for the transfer of detonation from one detonation activated tool to another detonation activated tool such that the detonation activated tools may be detonated in sequence.

The detonation transfer subassembly for the present invention comprises a first explosive carrying member and a second explosive carrying member. Each of these explosive carrying members has an explosive disposed therein. For example, the first explosive carrying member may have an explosive train including one or more boosters, a detonation cord and an unlined shaped charge. Similarly, the second explosive carrying member may have an explosive train including an initiator, one or more boosters and a detonation cord.

Disposed between the first and second explosive carrying members is a detonation transfer member. The detonation transfer member has a longitudinal passageway. In one embodiment, the detonation transfer member may include a barrel disposed within a housing such that a vent chamber is defined therebetween. In this embodiment, the longitudinal passageway is disposed within the barrel. In addition, the barrel may include one or more vent ports that create a communication path between the longitudinal passageway and the vent chamber.

A firing pin is disposed within the longitudinal passageway. The firing pin has a first position proximate the first explosive carrying member and a second position proximate the second explosive carrying member. The firing pin may be propelled from the first position to the second position in response to, for example, gas pressure generated by detonating the explosive disposed within the first explosive carrying member. Alternatively, a solid rocket propellant or other suitable propellant may be used or wellbore fluid pressure may be routed to the fire pin. In such an event, the firing pin impacts the explosive disposed within the second explosive carrying member, thereby transferring detonation from the first explosive carrying member to the second explosive carrying member.

To assure that the firing pin impacts the explosive disposed within the second explosive carrying member with sufficient force to detonate this explosive, the first explosive carrying member may include an expansion chamber for the gas generated from the detonation of the explosive or ignition of a propellant in the first explosive carrying member. In addition, the firing pin may be initially fixed relative to the barrel by a shear pin that selective prevents movement of the firing pin relative to the barrel until the force is sufficient to shear the shear pin. Finally, as the firing pin travels from the first position to the second position, air in the longitudinal chamber vents to the vent chamber to avoid creating unnecessary resistance to the movement of the firing pin.

As such, the detonation transfer subassembly of the present invention provides a region through which a tool string may be severed between two detonation activated tools that without the potential for detonating the detonation activated tools. Also, the detonation transfer subassembly of the present invention provides for the transfer of detonation from one detonation activated tool to another detonation activated tool through the detonation transfer member.

The method of the present invention for operating the detonation transfer subassembly involves, disposing a detonation transfer member between first and second explosive carrying members, creating a detonation within the first explosive member, propelling a firing pin from a first position proximate the first explosive carrying member to a second position proximate the second explosive carrying member through a longitudinal passageway in the detonation transfer member and impacting an explosive disposed within the second explosive member with the firing pin, thereby transferring detonation from the first explosive carrying member to the second explosive carrying member.

The method of the present invention for severing a work string between two detonation activated tools involves disposing a detonation transfer subassembly between the two detonation activated tools, positioning the detonation transfer member of the detonation transfer subassembly adjacent to shear rams of a blowout preventer and closing the shear rams of the blowout preventer, thereby severing the work string between the two detonation activated tools.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
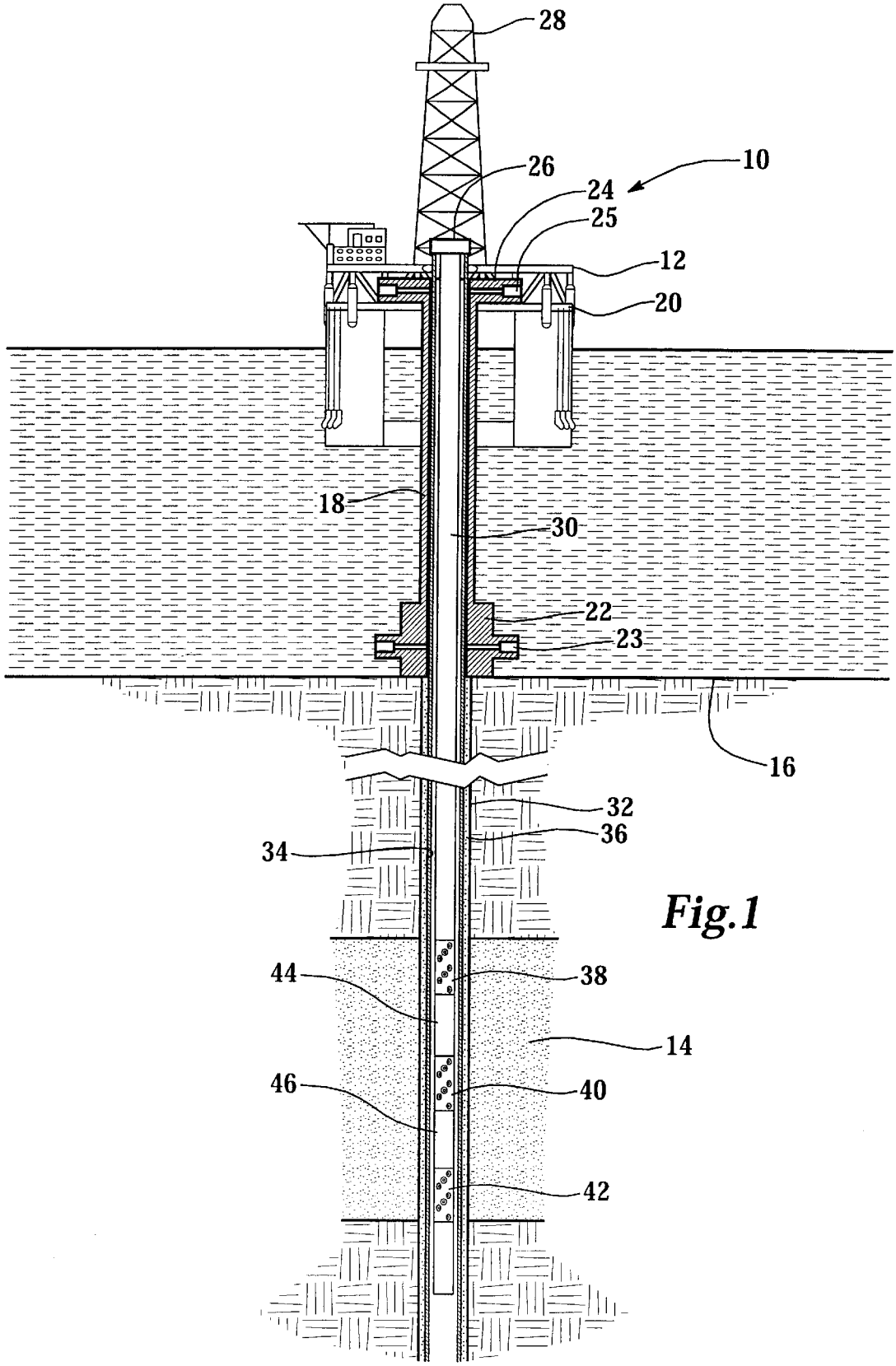
FIG. 1 is a schematic illustration of an offshore oil and gas platform operating a pair of detonation transfer subassemblies of the present invention that are disposed between successive perforating guns in a work string.

Referring initially to FIG. 1, a pair of detonation transfer subassemblies of the present invention operating from an offshore oil and gas platform is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including subsea blow-out preventers 23. Disposed on deck 20 is a surface installation 24 including shear ram preventers 25. Platform 12 has a hoisting apparatus 26 and a derrick 28 for raising and lowering pipe strings such as work sting 30.

A wellbore 32 extends through the various earth strata including formation 14. A casing 34 is cemented within wellbore 32 by cement 36. Work string 30 include various tools including shaped charge perforating guns 38, 40, 42 and detonation transfer subassemblies 44, 46. When it is desired to perforate formation 14, work string 30 is lowered through casing 34 until shaped charge perforating guns 38, 40, 42 are positioned adjacent to formation 14. Thereafter, shaped charge perforating guns 38, 40, 42 are sequentially fired such that the shaped charges are detonated. Upon detonation, the liners of the shaped charges form jets that create a spaced series of perforations extending outwardly through casing 34, cement 36 and into formation 14.

Even though FIG. 1 depicts a vertical well, it should be noted by one skilled in the art that the detonation transfer subassemblies of the present invention are equally well-suited for use in deviated wells, inclined wells or horizontal wells. Also, even though FIG. 1 depicts an offshore operation, it should be noted by one skilled in the art that the detonation transfer subassemblies of the present invention are equally well-suited for use in onshore operations.

Figure 2:
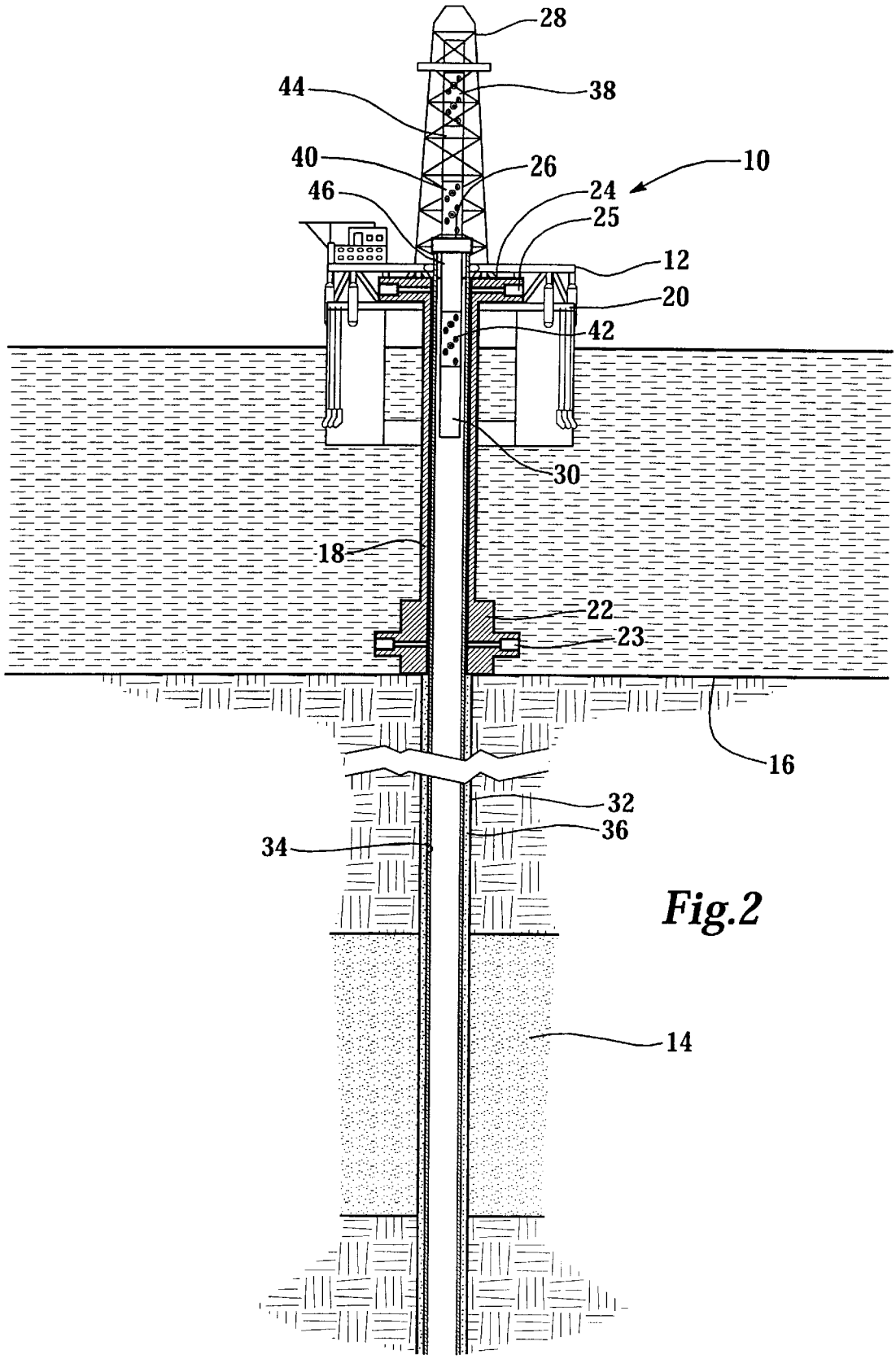
FIG. 2 is a schematic illustration of an offshore oil and gas platform depicting a work string tripping into or out of a well such that a detonation transfer subassembly of the present invention is adjacent to a set of shear ram preventers.
Figure 3:
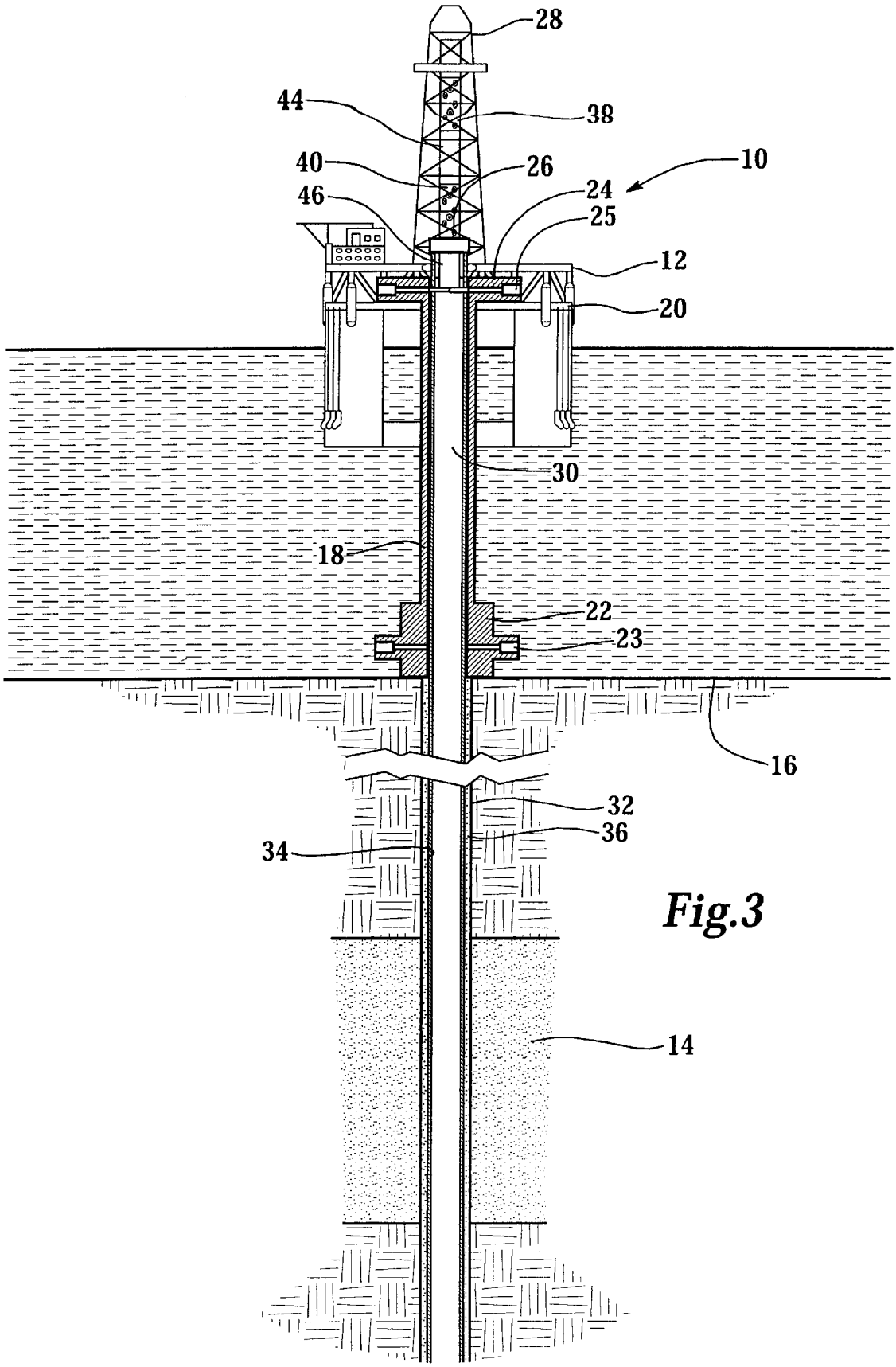
FIG. 3 is a schematic illustration of an offshore oil and gas platform depicting a work string after being severed by the shear ram preventers through a detonation transfer subassembly of the present invention.

In the event that the well traversing formation 14 become out of control while work string 30 include shaped charge perforating guns 38, 40, 42 and detonation transfer subassemblies 44, 46 are in the well, it may become necessary to shut in the well. For example, if the running of work string 30 into the well is a snubbing operation wherein another formation below formation 14 is live or if work string 30 is being tripped out of the well following the perforation operation and an uncontrolled situation occurs well, this could require a well shut in using shear ram preventers 25. If the portion of work string 30 having shaped charge perforating guns 38, 40, 42 is adjacent to shear ram preventers 25 when the out of control situation occurs and if live shaped charges remain in perforating guns 38, 40 or 42, closing shear ram preventers 25 could cause a detonation event. As illustrated in FIG. 2, using work string 30 having detonation transfer subassemblies 44, 46 positioned respectively between perforating guns 38, 40 and perforating guns 40, 42, one of the detonation transfer subassemblies such as detonation transfer subassembly 46 may be positioned adjacent to shear ram preventers 25. Once in this position, shear ram preventers 25 may be operated to shear through detonation transfer subassembly 46, as best seen in FIG. 3, to shut in the well without the potential for causing an unwanted detonation.

Figure 4A:
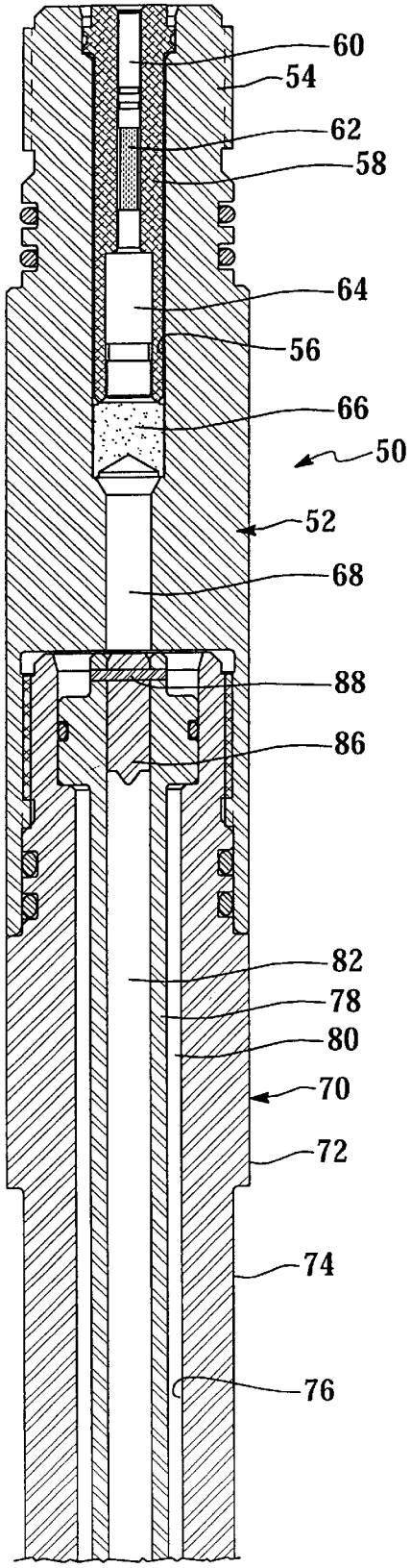
FIGS. 4A–4B are half sectional views of successive axial sections of a detonation transfer subassembly of the present invention prior to transferring detonation.
Figure 4B:
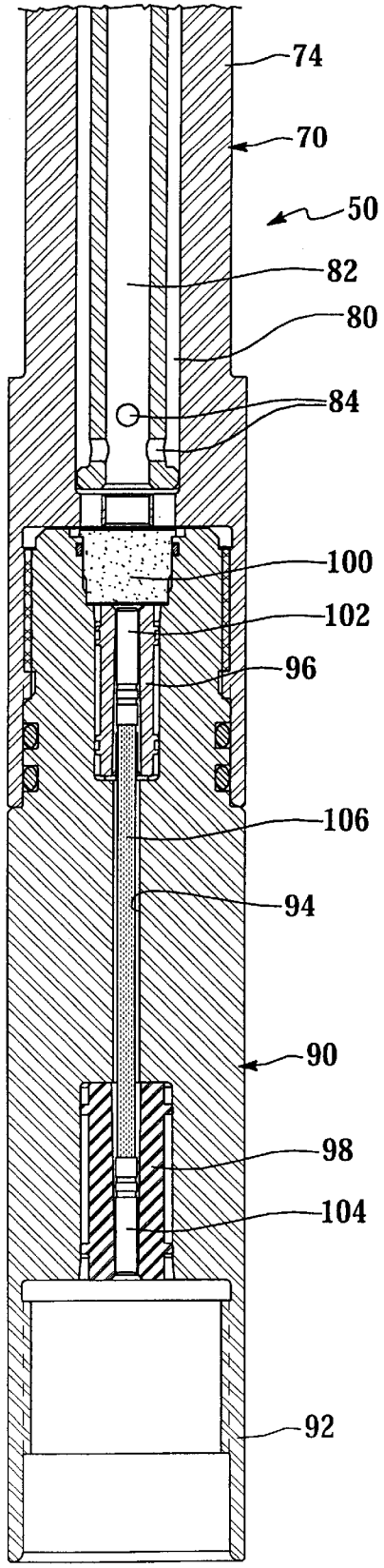

Referring now to FIGS. 4A–4B, therein is depicted a detonation transfer subassembly of the present invention prior to transferring detonation that is generally designated 50. Detonation transfer subassembly 50 includes an upper explosive carrying member 52 that has an upper pin end 54 that threadedly and sealingly couples with the lower box end of, for example, a perforating gun. Upper explosive carrying member 52 is a substantially cylindrical tubular member having a longitudinal bore 56 formed therein. Longitudinal bore 56 houses a holder member 58 which may be made from a suitable material such as steel or aluminum. Confined within holder member 58 is an explosive train that includes a booster 60, a detonation cord 62 such as RDX plastic cover Primacord, an initiator booster 64 and an unlined shaped charge 66. The lower portion of longitudinal bore 56 serves as an expansion chamber 68 the purpose of which will be explained in more detail below.

It should be apparent to those skilled in the art that the use of directional terms such as top, bottom, above, below, upper, lower, upward, downward, etc. are used in relation to the illustrative embodiments as they are depicted in the figures, the upward direction being toward the top of the corresponding figure and the downward direction being toward the bottom of the corresponding figure. As such, it is to be understood that the downhole components described herein may be operated in vertical, horizontal, inverted or inclined orientations without deviating from the principles of the present invention.

Detonation transfer subassembly 50 also includes a detonation transfer member 70 that is threadedly and sealingly coupled to the lower end of upper explosive carrying member 52. Detonation transfer member 70 is a substantially cylindrical tubular member having housing 72. Housing 72 has a radially reduced exterior region 74 that is preferably aligned with the shear ram preventers if the well in which detonation transfer subassembly 50 is disposed must be shut in and the shear ram preventers must be used to shear detonation transfer member 70. Housing 72 also has a longitudinal bore 76 formed therein. Disposed within longitudinal bore 76, in a substantially annularly spaced apart relationship, is a barrel 78. The annular space between longitudinal bore 76 and barrel 78 is a vent chamber 80, the purpose of which will be explained in more detail below. Barrel 78 defines a longitudinal passageway 82 therein. Barrel 78 also defines a plurality of vent ports 84 that create a path for communication between vent chamber 80 and longitudinal passageway 82. A firing pin 86 is disposed within longitudinal passageway 82. Firing pin 86 is initially fixed relative to barrel 78 by shear pin 88.

Detonation transfer subassembly 50 also includes a lower explosive carrying member 90 that has a lower box end 92 that threadedly and sealingly couples with the upper pin end of, for example, a perforating gun. At its upper end, lower explosive carrying member 90 is threadedly and sealingly coupled with the lower end of detonation transfer member 70. Lower explosive carrying member 90 is a substantially cylindrical tubular member having a longitudinal bore 94 formed therein. Longitudinal bore 94 houses a holder member 96 which may be made from a suitable material such as steel. Longitudinal bore 94 also houses a holder member 98 which may be made from a suitable material such as steel, aluminum or polymer. Disposed within longitudinal bore 94 above holder member 96 is a sealed initiator 100. Confined within holder member 96 is a booster 102 and confined within holder member 98 is a booster 104. Extending between booster 102 and booster 104 is a detonation cord 106. Together, initiator 100, booster 102, detonator cord 106 and booster 104 form an explosive train.

Under normal operation, detonation transfer subassembly 50 is used to transfer detonation from one detonation activated tool to another detonation activated tool such as from one shaped charge perforating gun to another as depicted in FIG. 1. This is achieved by receiving a detonation from the detonation activated tool that is threadedly and sealingly coupled to pin end 54 of upper explosive carrying member 52. This detonation then travels through the explosive train within upper explosive carrying member 52. Specifically, the detonation travels through booster 60, detonation cord 62, initiator booster 64 and finally to unlined shaped charge 66. Upon detonation of unlined shaped charge 66, a large volume of gas is generated that accumulates and pressurizes in expansion chamber 68.

Figure 5A:
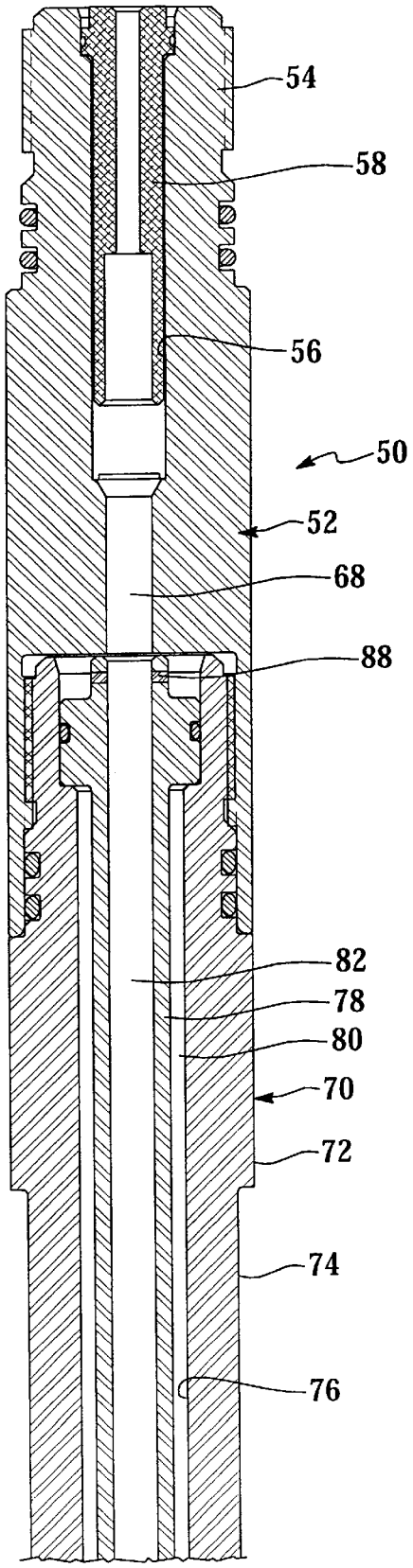
FIGS. 5A–5B are half sectional views of successive axial sections of a detonation transfer subassembly of the present invention after transferring detonation.
Figure 5B:
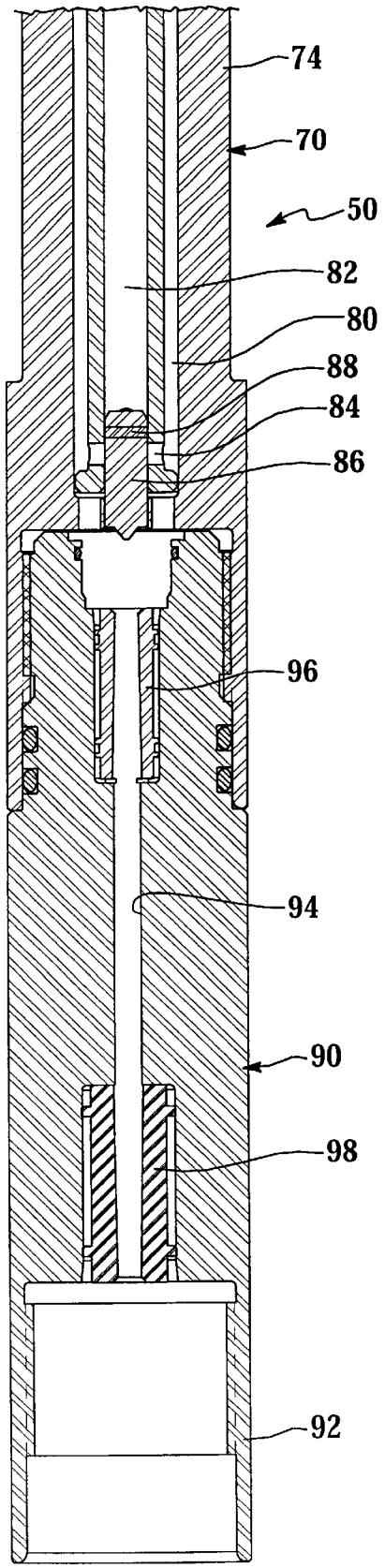

When the gas pressure in expansion chamber 68 reaches a predetermined level, the force created by the gas pressure on firing pin 86 shears pin 88. Once shear pin 88 has sheared, firing pin 86 is propelled from its position proximate upper explosive carrying member 52 through longitudinal passageway 82 until firing pin 86 impacts sealed initiator 100 in lower explosive carrying member 90, as best seen in FIGS. 5A–5B. Upon impact with sealed initiator 100, seal initiator 100 detonates which in turn sends a detonation down the explosive train in lower explosive carrying member 90 including booster 102, detonation cord 106 and booster 104. Booster 104 then transfers the detonation to the detonation activated tool that is threadedly and sealingly coupled to box end 92 of lower explosive carrying member 90. As such, detonation transfer subassembly 50 transfers detonation from one detonation activated tool to another detonation activated tool by transferring detonation from upper explosive carrying member 52 to lower explosive carrying member 92 through detonation transfer member 70.

Even though FIG. 4 has depicted the explosive train within upper explosive carrying member 52 as ending with unlined shaped charge 66 which generates the gas pressure in expansion chamber 68, it should be noted by those skilled in the art that other techniques may be used to propel firing pin 86 from its position proximate upper explosive carrying member 52 to its position impacting sealed initiator 100 in lower explosive carrying member 90. For example, the explosive train within upper explosive carrying member 52 could alternatively terminate in other types of propellants including, but not limited to, a solid rocket propellant. As another alternative, the explosive train within upper explosive carrying member 52 could terminate by opening a port to the exterior of detonation transfer subassembly 50 to allow high pressure fluid to enter expansion chamber 68 and provide the force to shear pin 88 and propel firing pin 88.

Importantly, the design of detonation transfer subassembly 50 assures that firing pin 86 impacts sealed initiator 100 with sufficient velocity to create detonation. Specifically, this is achieved by allowing gas generated by the detonation of unlined shaped charge 66 to expand and pressurize in expansion chamber 68. In addition, this is achieved by selectively preventing movement of firing pin 86 relative to barrel 78 until the force created by the gas pressure in expansion chamber 68 is sufficient to shear pin 88. Finally, this is achieved by allowing air in longitudinal chamber 82 to vent through ports 84 into vent chamber 80 as firing pin 86 travels through longitudinal chamber 82. As such, firing pin 86 strikes sealed initiator 100 with sufficient force to cause sealed initiator 100 to detonate.

Figure 6A:
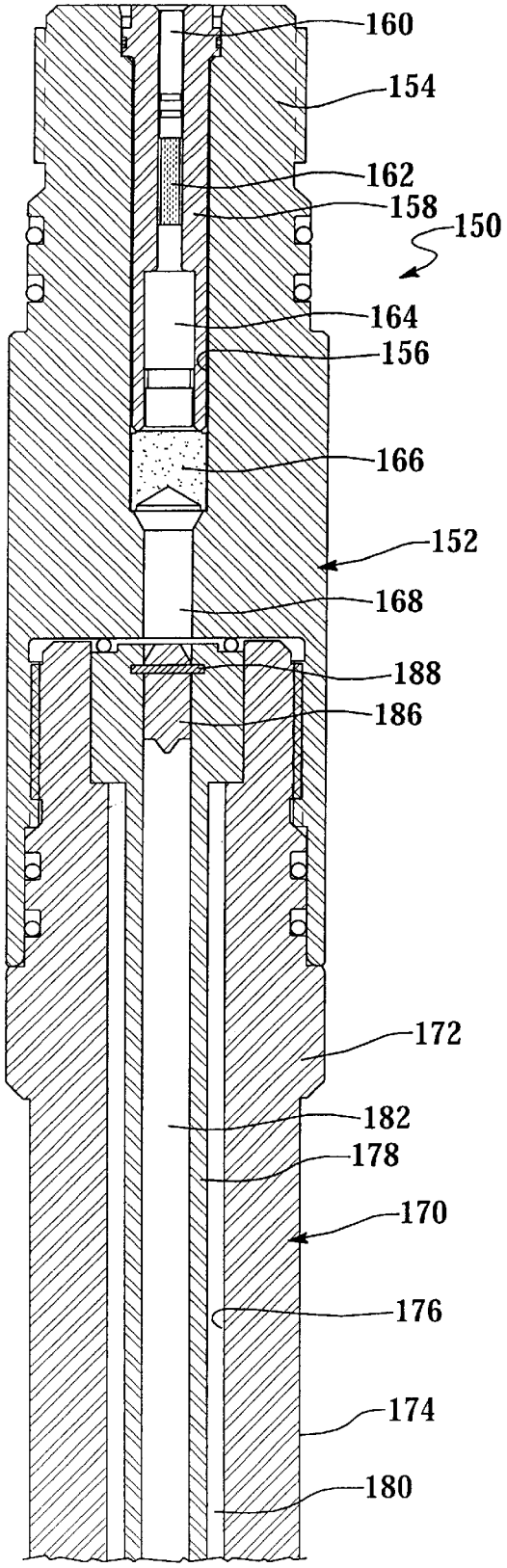
FIGS. 6A–6B are half sectional views of successive axial sections of a detonation transfer subassembly of the present invention prior to transferring detonation.
Figure 6B:
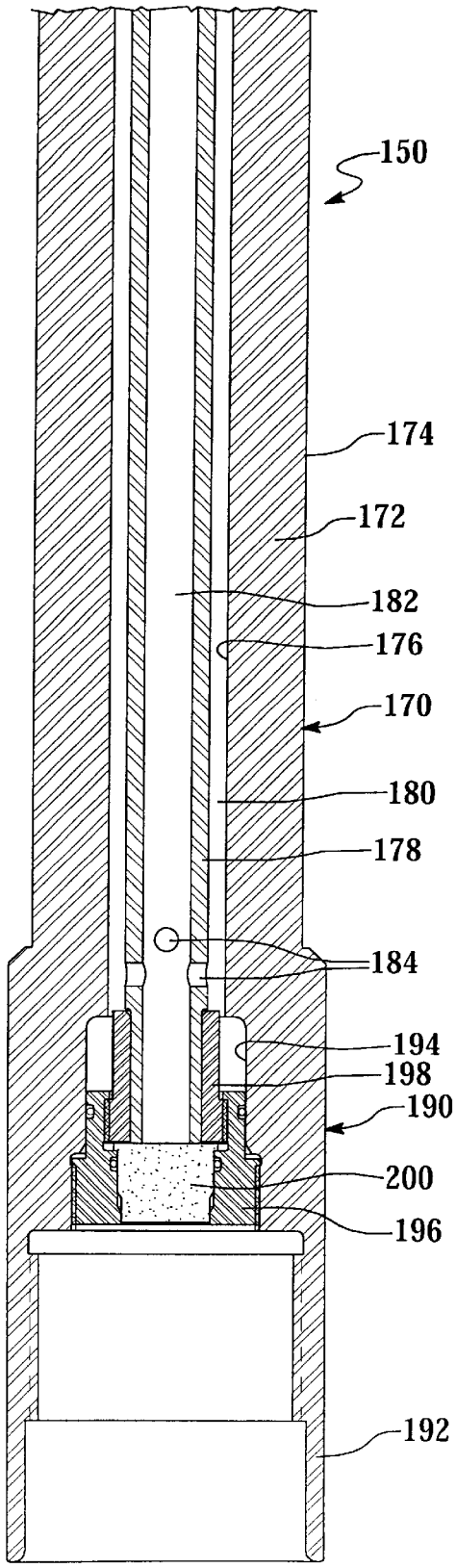

Referring now to FIGS. 6A–6B, therein is depicted a detonation transfer subassembly of the present invention prior to transferring detonation that is generally designated 150. Detonation transfer subassembly 150 includes an upper explosive carrying member 152 that has an upper pin end 154 that threadedly and sealingly couples with the lower box end of, for example, a perforating gun. Upper explosive carrying member 152 is a substantially cylindrical tubular member having a longitudinal bore 156 formed therein. Longitudinal bore 156 houses a holder member 158 which may be made from a suitable material such as steel or aluminum. Confined within holder member 158 is an explosive train that includes a booster 160, a detonation cord 162 such as RDX plastic cover Primacord, an initiator booster 164 and an unlined shaped charge 166. The lower portion of longitudinal bore 156 serves as an expansion chamber 168.

Detonation transfer subassembly 150 also includes a detonation transfer member 170 that is threadedly and sealingly coupled to the lower end of upper explosive carrying member 152. Detonation transfer member 170 is a substantially cylindrical tubular member having housing 172. Housing 172 has a radially reduced exterior region 174 that is preferably aligned with the shear ram preventers if the well in which detonation transfer subassembly 150 is disposed must be shut in and the shear ram preventers must be used to shear detonation transfer member 170. Housing 172 also has a longitudinal bore 176 formed therein. Disposed within longitudinal bore 176, in a substantially annularly spaced apart relationship, is a barrel 178. The annular space between longitudinal bore 176 and barrel 178 is a vent chamber 180. Barrel 178 defines a longitudinal passageway 182 therein. Barrel 178 also defines a plurality of vent ports 184 that create a path for communication between vent chamber 180 and longitudinal passageway 182. A firing pin 186 is disposed within longitudinal passageway 182. Firing pin 186 is initially fixed relative to barrel 178 by shear pin 188.

Detonation transfer subassembly 150 also includes a lower explosive carrying member 190 that has a lower box end 192 that threadedly and sealingly couples with the upper pin end of, for example, a perforating gun. In the illustrated embodiment, lower explosive carrying member 190 is integral with detonation transfer member 170. Lower explosive carrying member 190 has a bore 194 formed therein. Bore 194 houses a holder member 196 which may be made from a suitable material such as steel. Bore 194 also houses an alignment member 198 which may be made from a suitable material such as steel. Alignment member 198 receives the lower end of barrel 178 therein. Alignment member 198 is threadably coupled to holder member 196. Disposed within holder member 196 is a sealed initiator 200.

Under normal operation, detonation transfer subassembly 150 is used to transfer detonation from one detonation activated tool to another detonation activated tool such as from one shaped charge perforating gun to another as depicted in FIG. 1. This is achieved by receiving a detonation from the detonation activated tool that is threadedly and sealingly coupled to pin end 154 of upper explosive carrying member 152. This detonation then travels through the explosive train within upper explosive carrying member 152. Specifically, the detonation travels through booster 160, detonation cord 162, initiator booster 164 and finally to unlined shaped charge 166. Upon detonation of unlined shaped charge 166, a large volume of gas is generated that accumulates and pressurizes in expansion chamber 168.

Figure 7A:
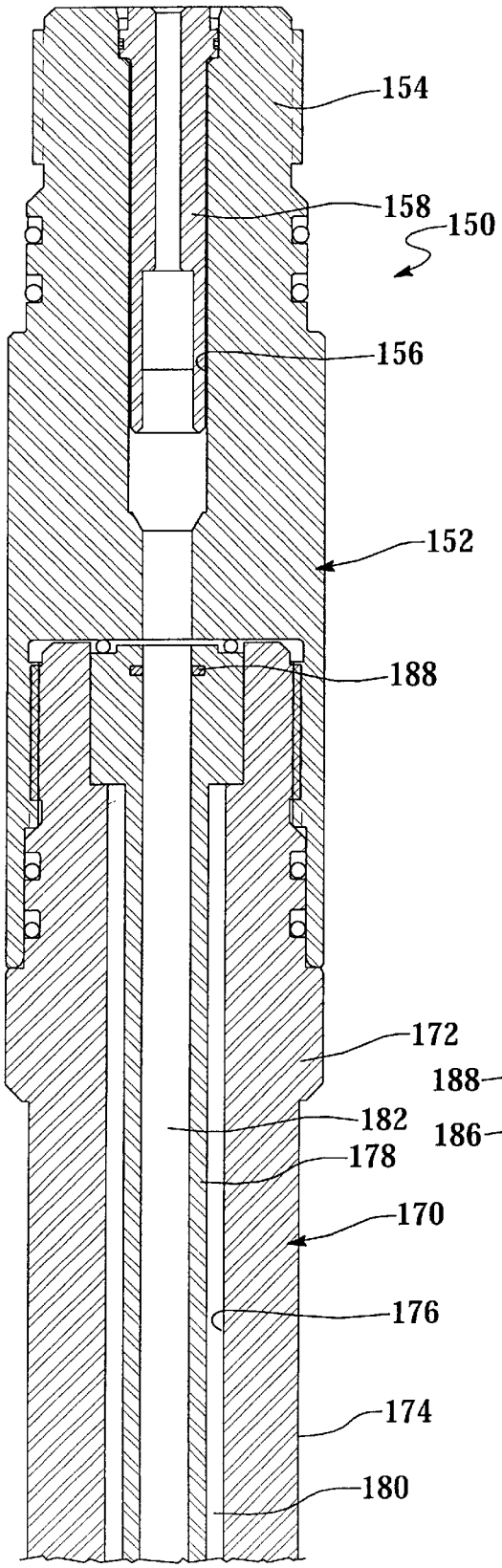
FIGS. 7A–7B are half sectional views of successive axial sections of a detonation transfer subassembly of the present invention after transferring detonation.
Figure 7B:
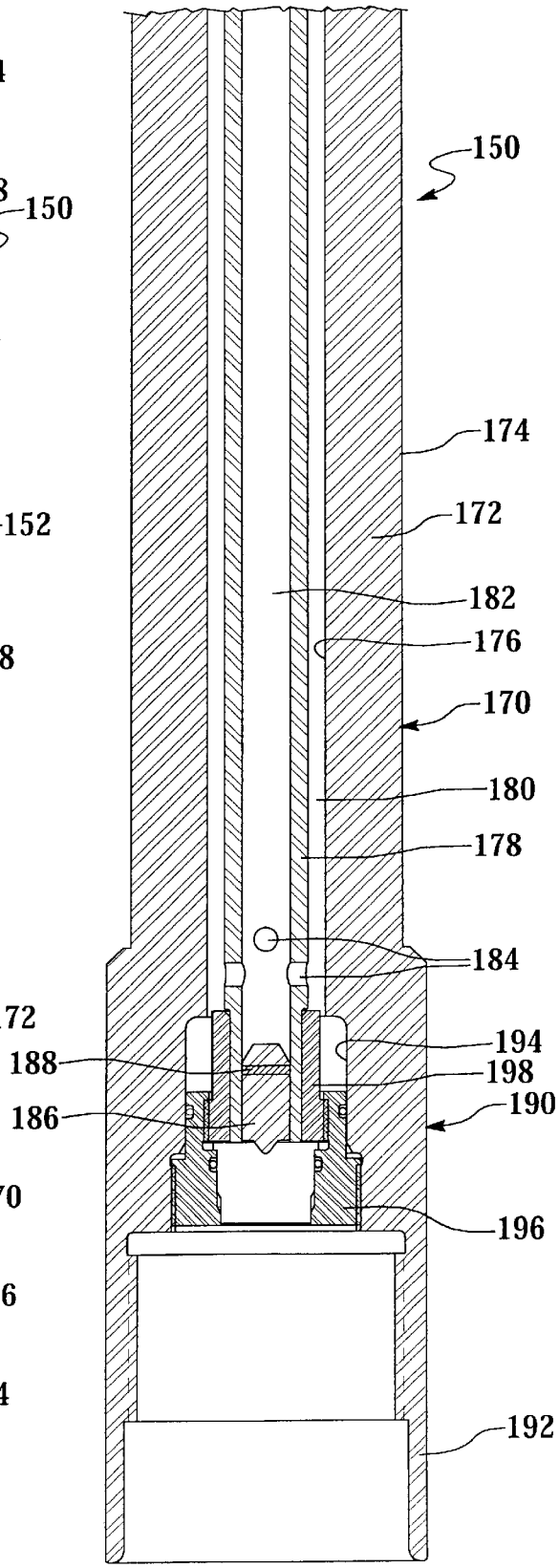

When the gas pressure in expansion chamber 168 reaches a predetermined level, the force created by the gas pressure on firing pin 186 shears pin 188. Once shear pin 188 has sheared, firing pin 186 is propelled from its position proximate upper explosive carrying member 152 through longitudinal passageway 182 until firing pin 186 impacts sealed initiator 200 in lower explosive carrying member 190, as best seen in FIGS. 7A–7B. Upon impact with sealed initiator 200, seal initiator 200 detonates which transfers the detonation to the detonation activated tool that is threadedly and sealingly coupled to box end 192 of lower explosive carrying member 190. As such, detonation transfer subassembly 150 transfers detonation from one detonation activated tool to another detonation activated tool by transferring detonation from upper explosive carrying member 152 to lower explosive carrying member 192 through detonation transfer member 170.

Importantly, the design of detonation transfer subassembly 150 assures that firing pin 186 impacts sealed initiator 200 with sufficient velocity to create detonation. Specifically, this is achieved by allowing gas generated by the detonation of unlined shaped charge 166 to expand and pressurize in expansion chamber 168. In addition, this is achieved by selectively preventing movement of firing pin 186 relative to barrel 178 until the force created by the gas pressure in expansion chamber 168 is sufficient to shear pin 188. Finally, this is achieved by allowing air in longitudinal chamber 182 to vent through ports 184 into vent chamber 180 as firing pin 186 travels through longitudinal chamber 182. As such, firing pin 186 strikes sealed initiator 200 with sufficient force to cause sealed initiator 200 to detonate.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A detonation transfer subassembly for coupling two detonation activated tools comprising:

first and second explosive carrying members;

a detonation transfer member disposed between the first and second explosive carrying members, the detonation transfer member having a longitudinal passageway therein; and a firing pin disposed within the longitudinal passageway, the firing pin having a first position proximate the first explosive carrying member and a second position proximate the second explosive carrying member, the firing pin being propellable from the first position to the second position following a detonation within the first explosive carrying member which generates a gas that expands in an expansion chamber, such that the firing pin impacts an explosive disposed within the second explosive carrying member, thereby transferring detonation from the first explosive carrying member to the second explosive carrying member.

2. The detonation transfer subassembly as recited in claim 1 wherein the first explosive carrying member further comprises a shaped charge disposed therein.

3. The detonation transfer subassembly as recited in claim 1 wherein the first explosive carrying member further comprises a booster disposed therein.

4. The detonation transfer subassembly as recited in claim 1 wherein the first explosive carrying member further comprises an explosive train including a first booster, a detonation cord, a second booster and a shaped charge disposed therein.

5. The detonation transfer subassembly as recited in claim 1 the detonation transfer member further comprises a barrel disposed within a housing defining a vent chamber therebetween and wherein the longitudinal passageway is disposed within the barrel.

6. The detonation transfer subassembly as recited in claim 5 wherein the barrel further includes a vent port such that air from within the longitudinal passageway vents to the vent chamber when the firing pin travels from the first position to the second position.

7. The detonation transfer subassembly as recited in claim 5 wherein the firing pin is initially fixed relative to the barrel by a shear pin that selective prevents movement of the firing pin relative to the barrel until a force applied to the firing pin shears the shear pin.

8. The detonation transfer subassembly as recited in claim 1 wherein the explosive in the second explosive carrying member further comprises an initiator.

9. The detonation transfer subassembly as recited in claim 1 wherein the explosive in the second explosive carrying member further comprises a booster.

10. The detonation transfer subassembly as recited in claim 1 wherein the explosive in the second explosive carrying member further comprises a detonation cord.

11. The detonation transfer subassembly as recited in claim 1 wherein the explosive in the second explosive carrying member further comprises an explosive train including art initiator, a first booster, a detonation cord and a second booster.

12. A detonation transfer subassembly for coupling two detonation activated tools in a work sting such that the work sting may be severed therethrough, the detonation transfer subassembly comprising:

a first explosive carrying member having a first explosive and a second explosive carrying member having a second explosive;

a detonation transfer member disposed between the first and the second explosive carrying members, the detonation transfer member having a housing and barrel disposed within a housing defining a vent chamber therebetween, the barrel defining longitudinal passageway and a vent port; and a firing pin disposed within the longitudinal passageway, the firing pin having a first position proximate the first explosive carrying member and a second position proximate the second explosive carrying member, the firing pin being propellable from the first position to the second position following a detonation within the first explosive carrying member such that air from within the longitudinal passageway vents to the vent chamber through the vent port and such that the firing pin impacts the second explosive, thereby transferring detonation from the first to the second explosive carrying member.

13. The detonation transfer subassembly as recited in claim 12 wherein the first explosive carrying member further comprises a shaped charge disposed therein.

14. The detonation transfer subassembly as recited in claim 12 wherein the first explosive carrying member further comprises a booster disposed therein.

15. The detonation transfer subassembly as recited in claim 12 wherein the first explosive carrying member further comprises an explosive train including a first booster, a detonation cord, a second booster and a shaped charge dispose therein.

16. The detonation transfer subassembly as recited in claim 12 wherein the detonation within the first explosive carrying member generates a gas.

17. The detonation transfer subassembly as recited in claim 16 wherein the first explosive carrying member further comprises an expansion chamber for the gas to expand.

18. The detonation transfer subassembly as recited in claim 16 wherein the firing pin is initially fixed relative to the barrel by a shear pin that selective prevents movement of the firing pin relative to the barrel until a force applied to the firing pin shears the shear pin.

19. The detonation transfer subassembly as recited in claim 12 wherein the second explosive further comprises an initiator.

20. The detonation transfer subassembly as recited in claim 12 wherein the second explosive further comprises a booster.

21. The detonation transfer subassembly as recited in claim 12 wherein the second explosive further comprises a detonation cord.

22. The detonation transfer subassembly as recited in claim 12 wherein the second explosive further comprises an explosive train including an initiator, a first booster, a detonation cord and a second booster.

23. A detonation transfer subassembly comprising first and second explosive carrying members having a detonation transfer member disposed therebetween, the detonation transfer member having a longitudinal passageway with a tiring pin disposed therein, the firing pin propelled from a first position proximate the first explosive carrying member to a second position proximate the second explosive carrying member following a detonation within the first explosive carrying member such that the firing pin impacts an explosive train including an initiator, a first booster, a detonation cord and a second booster disposed within the second explosive carrying member, thereby transferring detonation from the first to the second explosive carrying member.

24. The detonation transfer subassembly as recited in claim 23 wherein the first explosive carrying member further comprises a shaped charge disposed therein.

25. The detonation transfer subassembly as recited in claim 23 wherein the first explosive carrying member further comprises an explosive train including a first booster, a detonation cord, a second booster and a shaped charge disposed therein.

26. The detonation transfer subassembly as recited in claim 23 wherein the detonation within the first explosive carrying member generates a gas and wherein the first explosive carrying member further comprises an expansion chamber for the gas to expand.

27. The detonation transfer subassembly as recited in claim 23 wherein the detonation transfer member further comprises a barrel disposed within a housing defining a vent chamber therebetween and wherein the longitudinal passageway is disposed within the barrel.

28. The detonation transfer subassembly as recited in claim 27 wherein the barrel further includes a vent port such that air from within the longitudinal passageway vents to the vent chamber when the firing pin travels from the first position to the second position.

29. The detonation transfer subassembly as recited in claim 27 wherein the firing pin is initially fixed relative to the barrel by a shear pin that selective prevents movement of the firing pin relative to the barrel until a force applied to the firing pin shears the shear pin.

30. The detonation transfer subassembly as recited in claim 23 wherein the explosive in the second explosive carrying member further comprises an initiator.

31. A method for transferring detonation from a first explosive carrying member to a second explosive carrying member comprising the steps of:

disposing a detonation transfer member between the first and second explosive carrying members, the detonation transfer member having a longitudinal passageway defined therein;

creating a detonation within the first explosive carrying member;

expanding a gas in an expansion chamber in the first explosive carrying member;

propelling a firing pin from a first position proximate the first explosive carrying member to a second position proximate the second explosive carrying member through the longitudinal passageway; and impacting an explosive disposed within the second explosive with the firing pin, thereby transferring detonation from the first explosive carrying member to the second explosive carrying member.

32. The method as recited in claim 31 wherein the step of creating a detonation within the first explosive carrying member further comprises detonating a shaped charge.

33. The method as recited in claim 31 wherein the step of creating a detonation within the first explosive carrying member further comprises detonating an explosive train including a first booster, a detonation cord, a second booster and a shaped charge.

34. The method as recited in claim 31 further comprising the step of venting gas from the longitudinal passageway to a vent chamber disposed between a barrel and a housing of the detonation transfer member through a vent port in the barrel.

35. The method as recited in claim 31 further comprising the step of selectively preventing the propulsion of the firing pin from the first position to the second position with a shear pin until the force created by the gas pressure on the firing pin shears the shear pin.

36. The method as recited in claim 31 wherein the step of impacting an explosive disposed within the second explosive member with the firing pin further comprises impacting an initiator.

37. The method as recited in claim 31 wherein the step of impacting an explosive disposed within the second explosive member with the firing pin further comprises impacting an initiator to detonate an explosive train including a first booster, a detonation cord and a second booster.

38. A method for transferring detonation from a first explosive carrying member to a second explosive carrying member comprising the steps of:

disposing a detonation transfer member between the first and second explosive carrying members, the detonation transfer member having a housing with a barrel disposed therein defining a vent chamber therebetween, the barrel defining a longitudinal passageway therein and a vent port;

creating a detonation within the first explosive carrying member;

propelling a firing pin through the longitudinal passageway such that air from the longitudinal passageway vents to the vent chamber through the vent port; and impacting an explosive disposed within the second explosive member with the firing pin, thereby transferring detonation from the first explosive carrying member to the second explosive carrying member.

39. The method as recited in claim 38 wherein the step of creating a detonation within the first explosive carrying member further comprises detonating a shaped charge.

40. The method as recited in claims 38 wherein the step of creating a detonation within the first explosive carrying member further comprises detonating an explosive train including a first booster, a detonation cord, a second booster and a shaped charge.

41. The method as recited in claim 38 wherein the step of creating a detonation within the first explosive carrying member further comprises the step of expanding a gas in an expansion chamber in the first explosive carrying member.

42. The method as recited in claim 41 further comprising the step of selectively preventing the movement of the firing pin from the first position to the second position with a shear pin until the force created by the gas pressure on the firing pin shears the shear pin.

43. The method as recited in claim 38 wherein the step of impacting an explosive disposed within the second explosive member with the tiring pin further comprises impacting an initiator.

44. The method as recited in claim 38 wherein the step of impacting an explosive disposed within the second explosive member with the firing pin further comprises impacting an initiator to detonate an explosive train including a first booster, a detonation cord and a second booster.

45. A method for severing a work string between two detonation activated tools comprising the steps of:

disposing a detonation transfer subassembly between the two detonation activated tools, the detonation transfer subassembly including a longitudinal passageway with a firing pin disposed therein, the firing pin being propellable from a first position proximate a first explosive carrying member to a second position proximate a second explosive carrying member following a detonation within the first explosive carrying member which generates a gas that expands in an expansion chamber, such that when the firing pin is propelled, the firing pin impacts an explosive disposed within the second explosive carrying member which transfers detonation from the first to the second explosive carrying member;

positioning the detonation transfer member adjacent to shear rams; and closing the shear rams, thereby severing the work string between the two detonation activated tools.

46. A method for severing a work string between two detonation activated tools comprising the steps of:

disposing a detonation transfer subassembly between the two detonation activated tools, the detonation transfer subassembly including a housing and a barrel disposed within the housing defining a vent chamber therebetween, the barrel having a vent port and defining a longitudinal passageway with a firing pin disposed therein, the firing pin being propellable from a first position proximate a first explosive carrying member to a second position proximate a second explosive carrying member following a detonation within the first explosive carrying member, such that when the firing pin is propelled, the firing pin impacts an explosive disposed within the second explosive carrying member which transfers detonation from the first to the second explosive carrying member;

positioning the detonation transfer member adjacent to shear rams; and closing the shear rams, thereby severing the work string between the two detonation activated tools.

* * * * *